US005923343A

United States Patent [19]

Brosseau et al.

[11] Patent Number: 5,923,343

[45] Date of Patent: Jul. 13, 1999

[54] MAILING MACHINE HAVING A REGISTRATION SHIELD WITH IMPROVED AIR FLOW CAPABILITY DURING INK JET PRINTING ON ENVELOPES

[75] Inventors: William A. Brosseau, Stratford, Conn.; Mark M. Broschart, Spring Hill, Tenn.; David B. Wilk, Clinton; Claude Zeller, Monroe, both of Conn.

[73] Assignee: Pitney Bowes Inc., Stamford, Conn.

[21] Appl. No.: 08/951,073

[22] Filed: Oct. 15, 1997

[51] Int. Cl.[6] ..... B41J 3/00

[52] U.S. Cl. ..... 347/4

[58] Field of Search ..... 347/108, 109, 347/4, 22; 400/48, 247, 526, 536, 622, 645.1, 713

[56] References Cited

U.S. PATENT DOCUMENTS

| | | | |
|---|---|---|---|
| 5,356,229 | 10/1994 | Hickman et al. | 400/642 |
| 5,467,709 | 11/1995 | Salomon | 347/4 |
| 5,625,398 | 4/1997 | Milkovits et al. | 347/104 |

FOREIGN PATENT DOCUMENTS

| | | | |
|---|---|---|---|
| 63-299940 | 12/1988 | Japan | 347/35 |

*Primary Examiner*—N. Le
*Assistant Examiner*—Thien Tran
*Attorney, Agent, or Firm*—Angelo N. Chaclas; Melvin J. Scolnick

[57] ABSTRACT

Mailing machine comprising a printer module including an array of ink jet print elements for printing on an envelope having a top surface, a registration shield located below and spaced apart from the printer module and a transport apparatus. The registration shield includes a top surface and a bottom surface and has an opening through which the array of ink jet print elements project ink onto the top surface of the envelope. The transport apparatus feeds the envelope in a path of travel so that the envelope passes between the registration shield and the printer module. Additionally, the transport apparatus includes a device for biasing the top surface of the envelope into contact with the registration shield. The registration shield further includes a channel extending parallel to the path of travel and in substantial alignment with the opening so that the top surface of the envelope in proximity to the channel does not contact the bottom surface of the registration shield so as to allow air to flow through the opening.

9 Claims, 4 Drawing Sheets

MAILING MACHINE HAVING A REGISTRATION SHIELD WITH IMPROVED AIR FLOW CAPABILITY DURING INK JET PRINTING ON ENVELOPES

FIELD OF THE INVENTION

This invention relates to a registration shield for ink jet printing in a mailing machine. More particularly, this invention is directed to a registration shield having an opening for permitting an ink jet print head to print on an envelope and a channel along a bottom surface of the registration shield for allowing air to flow along the channel and through the opening.

BACKGROUND OF THE INVENTION

Ink jet printers are well known in the art. Generally, an ink jet printer includes an array of nozzles or orifices, a supply of ink, a plurality of ejection elements (typically either expanding vapor bubble elements or piezoelectric transducer elements) corresponding to the array of nozzles and suitable driver and control electronics for controlling the ejection elements. Typically, the array of nozzles and the ejection elements along with their associated components are referred to as a print head. It is the activation of the ejection elements that causes drops of ink to be expelled from the nozzles. The ink ejected in this manner forms drops which travel along a flight path until they reach a print medium such as a sheet of paper, overhead transparency, envelope or the like. Once they reach the print medium, the drops dry and collectively form a print image. Typically, the ejection elements are selectively activated or energized as relative movement is provided between the print head and the print medium so that a predetermined or desired print image is achieved.

Generally, the array of nozzles, supply of ink, plurality of ejection elements and driver electronics are packaged into an ink jet cartridge. In turn, the printer includes a carriage assembly for detachably mounting the ink jet cartridge thereto. In this manner, a fresh ink jet cartridge may be installed when the ink supply of the current ink cartridge has been consumed. Additionally, the printer typically includes a maintenance module for capping, wiping and generally keeping the ink jet cartridge in proper working order.

Recently, the postage meter mailing machine industry and other envelope printing industries have begun to incorporate ink jet printers having user replaceable ink jet cartridges. A typical postage meter (one example of a postage printing apparatus) applies evidence of postage, commonly referred to as a postal indicia, to an envelope or other mailpiece and accounts for the value of the postage dispensed. As is well known, postage meters include an ascending register that stores a running total of all postage dispensed by the meter and a descending register that holds the remaining amount of postage credited to the meter and that is reduced by the amount of postage dispensed during a transaction.

Generally, the postage meter may be incorporated into a mailing machine, which is also well known in the art, for automated handling of the mailpieces. Mailing machines are readily available from manufacturers such as Pitney Bowes Inc. of Stamford, Conn., USA and often include a variety of different modules, which automate the processes of producing mailpieces. The typical mailing machine includes a variety of different modules or sub-systems where each module performs a different task on a mailpiece, such as: singulating (separating the mailpieces one at a time from a stack of mailpieces), weighing, sealing (wetting and closing the glued flap of an envelope), applying evidence of postage, accounting for postage used (performed by the postage meter), feeding roll tape or cut tape strips for printing and stacking finished mailpieces. However, the exact configuration of each mailing machine is particular to the needs of the user. Customarily, the mailing machine also includes a transport apparatus, which feeds the mailpieces in a path of travel through the successive modules of the mailing machine.

A primary concern in mailing machine environments is the generation of paper dust. Generally, envelopes contain more loose fibers than conventional office printer paper. As a result, mailing machines accumulate more paper dust than office printers. Since the print quality of ink jet printers is negatively influenced by the presence of paper dust and other contaminants around the array of nozzles, it is desirable to reduce the amount of paper dust that collects on the ink jet cartridge during printing operations.

Therefore, there is a need for a mailing machine including a registration shield that reduces the amount of paper dust on the array of nozzles when the nozzles are exposed to ambient air during printing operations.

SUMMARY OF THE INVENTION

In accordance with the present invention, there is provided a machine including a mailing machine comprising a printer module including an array of ink jet print elements for printing on an envelope having a top surface, a registration shield located below and spaced apart from the printer module and a transport apparatus. The registration shield includes a top surface and a bottom surface and has an opening through which the array of ink jet print elements project ink onto the top surface of the envelope. The transport apparatus feeds the envelope in a path of travel so that the envelope passes between the registration shield and the printer module. Additionally, the transport means includes a device for biasing the top surface of the envelope into contact with the registration shield. The registration shield further includes a channel extending parallel to the path of travel and in substantial alignment with the opening so that the top surface of the envelope in proximity to the channel does not contact the bottom surface of the registration shield so as to allow air to flow through the opening.

Therefore, it should now be apparent that the present invention substantially overcomes the disadvantages associated with the prior art. Additional advantages of the invention will be set forth in the description, which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Figure 1:
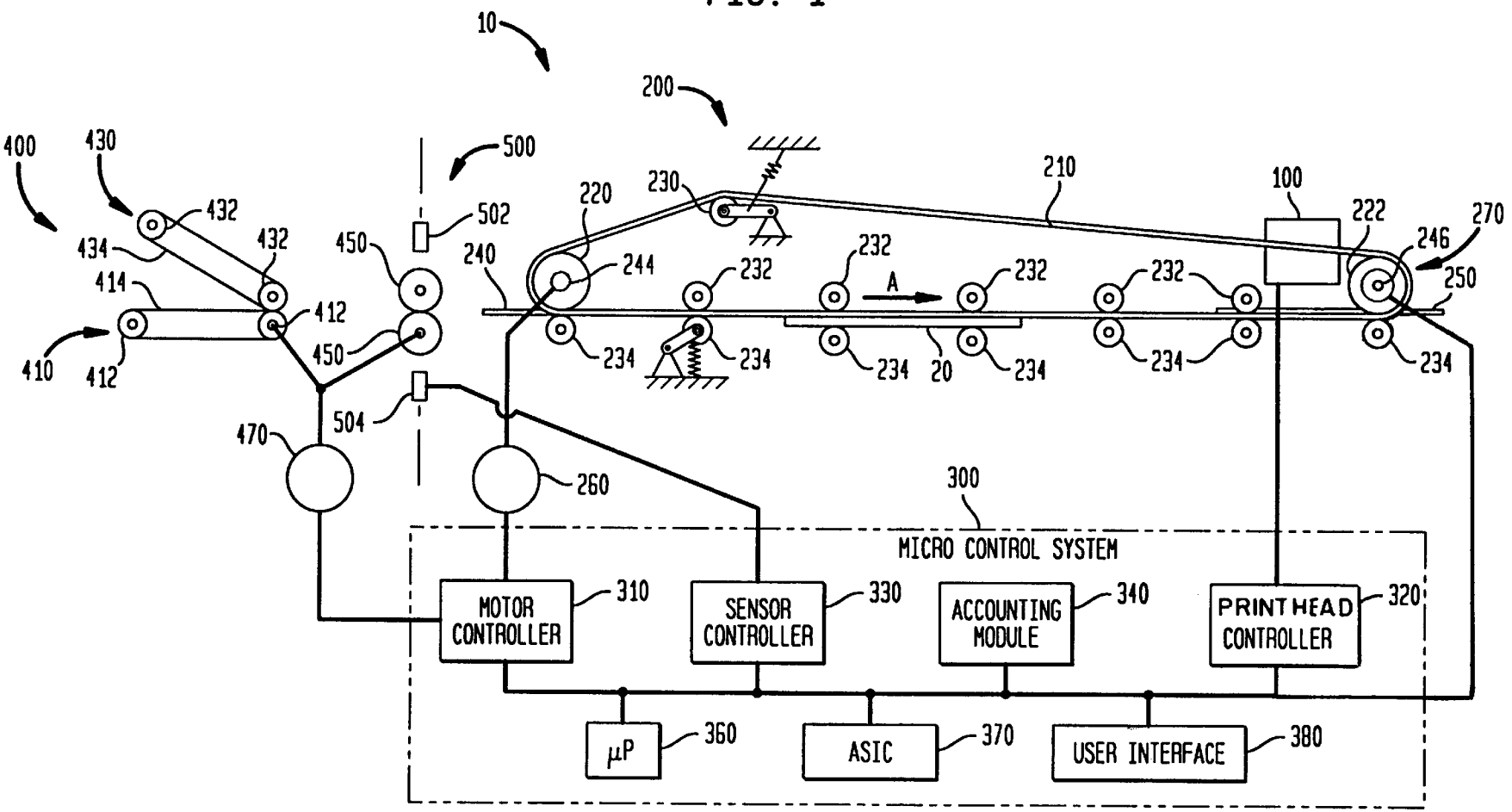
FIG. 1 is a simplified schematic of a front elevational view of a mailing machine in which the present invention may be incorporated.

Referring to FIG. 1, an example of a mailing machine 10 in which the present invention may be incorporated is shown. The mailing machine 10 includes a printer module 100, a conveyor apparatus 200, a micro control system 300, a singulator module 400 and a user interface 380 for providing communication between an operator and the mailing machine 10. Other modules of the mailing machine 10, such as those described above, have not been shown for the sake of clarity. The singulator module 400 receives a stack of envelopes (not shown), or other mailpieces such as postcards, folders and the like, and separates and feeds them in a seriatim fashion (one at a time) in a path of travel as indicated by arrow A. The conveyor apparatus 200 feeds the envelopes 20 in the path of travel along a deck 240 past the printer module 100 so that a postal indicia can be printed on each envelope 20. Together, the singulator module 400 and the conveyor module 200 make up a transport apparatus for feeding the envelopes 20 through the various modules of the mailing machine 10.

The singulator module 400 includes a feeder assembly 410 and a retard assembly 430 which work cooperatively to separate a batch of envelopes (not shown) and feed them one at a time to a pair of take-away rollers 450. The feeder assembly 410 includes a pair of pulleys 412 having an endless belt 414 extending therebetween. The feeder assembly 410 is operatively connected to a motor 470 by any suitable drive train which causes the endless belt 414 to rotate clockwise so as to feed the envelopes in the direction indicated by arrow A. The retard assembly 430 includes a pair of pulleys 432 having an endless belt 434 extending therebetween. The retard assembly 430 is operatively connected to any suitable drive means (not shown) which causes the endless belt 434 to rotate clockwise so as to prevent the upper envelopes in the batch of envelopes from reaching the take-away rollers 450. In this manner, only the bottom envelope in the stack of envelopes advances to the take-away rollers 450. Those skilled in the art will recognize that the retard assembly 430 may be operatively coupled to the same motor 470 as the feeder assembly 410.

Since the details of the singulator module 400 are not necessary for an understanding of the present invention, no further description will be provided. However, an example of a singulator module suitable for use in conjunction with the present invention is described in U.S. Pat. No. 4,978,114, entitled REVERSE BELT SINGULATING APPARATUS, the disclosure of which is specifically incorporated herein by reference.

The take-away rollers 450 are located adjacent to and downstream in the path of travel from the singulator module 400. The take-away rollers 450 are operatively connected to motor 470 by any suitable drive train (not shown). Generally, it is preferable to design the feeder assembly drive train and the take-away roller drive train so that the take-away rollers 450 operate at a higher speed than the feeder assembly 410. Additionally, it is also preferable that the take-away rollers 450 have a very positive nip so that they dominate control over the envelope 20. Consistent with this approach, the nip between the feeder assembly 410 and the retard assembly 430 is suitably designed to allow some degree of slippage.

The mailing machine 10 further includes a sensor module 500, which is substantially in alignment with the nip of take-away rollers 450 for detecting the presence of the envelope 20. Preferably, the sensor module 500 is of any conventional optical type, which includes a light emitter 502 and a light detector 504. Generally, the light emitter 502 and the light detector 504 are located in an opposed relationship on opposite sides of the path of travel so that the envelope 20 passes therebetween. By measuring the amount of light that the light detector 504 receives, the presence or absence of the envelope 20 can be determined. Generally, by detecting the lead and trail edges of the envelope 20, the sensor module 500 provides signals to the micro control system 300 which are used to determine the length of the envelope 20 and measure the gap between successive envelopes 20.

The conveyor apparatus 200 includes an endless belt 210 looped around a drive pulley 220 and an encoder pulley 222 which is located downstream in the path of travel from the drive pulley 220 and proximate to the printer module 100. The drive pulley 220 and the encoder pulley 222 are substantially identical and are fixably mounted to shafts 244 and 246, respectively, which are in turn rotatively mounted to any suitable structure (not shown) such as a frame. The drive pulley 220 is operatively connected to a motor 260 by any conventional means such as intermeshing gears (not shown) or a timing belt (not shown) so that when the motor 260 rotates in response to signals from the micro control system 300, the drive pulley 220 also rotates which in turn causes the endless belt 210 to rotate and advance the envelope 20 along the path of travel.

The conveyor apparatus 200 further includes a plurality of idler pulleys 232, a plurality of normal force rollers 234 and a tensioner pulley 230. The tensioner pulley 230 is initially spring biased and then locked in place by any conventional manner such as a set screw and bracket (not shown). This allows for constant and uniform tension on the endless belt 210. In this manner, the endless belt 210 will not slip on the drive pulley 220 when the motor 260 is energized and caused to rotate. The idler pulleys 232 are rotatively mounted to any suitable structure (not shown) along the path of travel between the drive pulley 220 and the encoder pulley 222. The normal force rollers 234 are located in opposed relationship and biased toward the idler pulleys 232, the drive pulley 220 and the encoder pulley 222, respectively. For clarity, only one of the idler pulleys 232 has been shown with the biasing structure.

As described above, the normal force rollers 234 work to bias the envelope 20 up against the deck 240. This is commonly referred to as top surface registration, which is beneficial for ink jet printing. In the area of the print module 100, a registration shield 250, the details of which are provided below, is utilized to define the print gap between the top surface of the envelope 20 and the array of nozzles (not shown). The registration shield 250 is fixably mounted to any suitable structure such as a frame (not shown). In this manner, any variation in thickness of the envelope 20 is taken up by the deflection of the normal force rollers 234. Thus, a constant print gap is set between the envelope 20 and the printer module 100 no matter what the thickness of the envelope 20. The constant print gap is optimally set to a desired value to achieve quality printing. It is important to note that the deck 240 contains suitable openings (not shown) for the endless belt 210 and normal force rollers 234.

Figure 3:
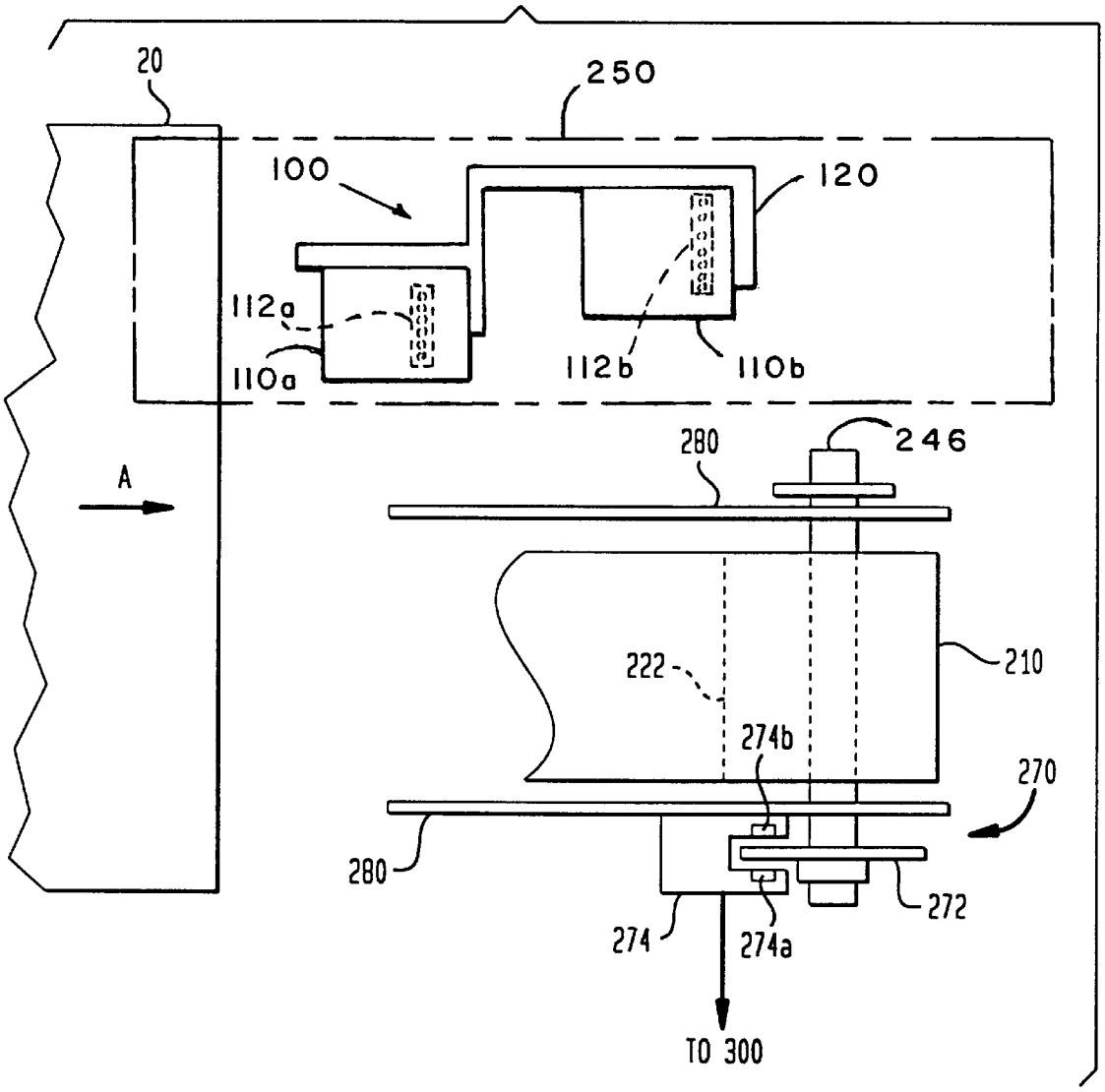
FIG. 3 is a simplified schematic representation of a plan view of a printer module, an encoder pulley, an encoder system and the registration shield (in phantom) in accordance with the invention.

Referring to FIGS. 1 and 3, the conveyor apparatus 200 also includes an encoder system 270, which is located proximate to the printer module 100 and operatively coupled to the encoder pulley 222. The encoder system 270 includes an encoder disk 272 fixably mount to the shaft 246 and an encoder detector 274 fixably mounted to the frame 280. Thus, as the encoder pulley 222 rotates so does the encoder disk 272. The encoder disk 272 has a plurality of vanes located around its circumference and is of a conventional type, such as model number HP 5100 available from Hewlett-Packard Company. The encoder detector 274 is also of conventional type; such as model number HP 9100 available from Hewlett-Packard Company, and includes a light source 274*a* and a light detector 274*b*. The encoder disk 272 and the encoder detector 274 are positioned with respect to each other so that the vanes of the encoder disk 272 alternately block and unblock the light source 274*a* as the shaft 246 rotates. The transition from blocked to unblocked or vice versa results in a change of state or encoder signal (also commonly referred to as a "count") for the encoder detector 274. The encoder disk 272 has been selected so that 1024 counts occur per revolution. In this manner, the position and speed of the shaft 246 can be tracked. This type of encoder system 270 is well known and those skilled in the art will recognize other means for encoding, which would serve equally well.

In the preferred embodiment, the printer module 100 includes a carriage 120, a first ink jet cartridge 110*a* having an array of nozzles 112*a* and a second ink jet cartridge 110*b* having an array of nozzles 112*b*, both of which are separately detachably mounted to the carriage 120 by any conventional means. An outline of the registration shield 250 is shown in phantom (for the sake of clarity) providing an indication of the relationship between the registration shield 250 and the cartridges 110*a* and 110*b*. The details of the registration shield 250 will be described further below.

Generally, the distance between the ink jet cartridge 110*a* and the second ink jet cartridge 110*b* as measured along the path of travel is necessary for packaging considerations. Typically, high performance print heads capable of high resolution printing at high speeds are only available in linear arrays of small length. Thus, to print a wide swath across the envelope 20 requires the alignment of multiple ink jet cartridges in end-to-end fashion as measured in a direction transverse to the path of travel. The use of multiple print heads in this fashion increases the print zone over which accurate encoding needs to take place because encoding must now occur over the print area plus the distance between the ink jet cartridges. Those skilled in the art will recognize that any number of ink jet cartridges can be arranged in this or analogous manners to achieve any desired effective print swath.

Figure 2B:
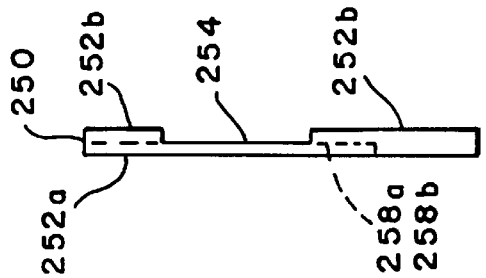
FIG. 2*b* is an end view of the registration shield for use in the mailing machine in accordance with the present invention.
Figure 2A:
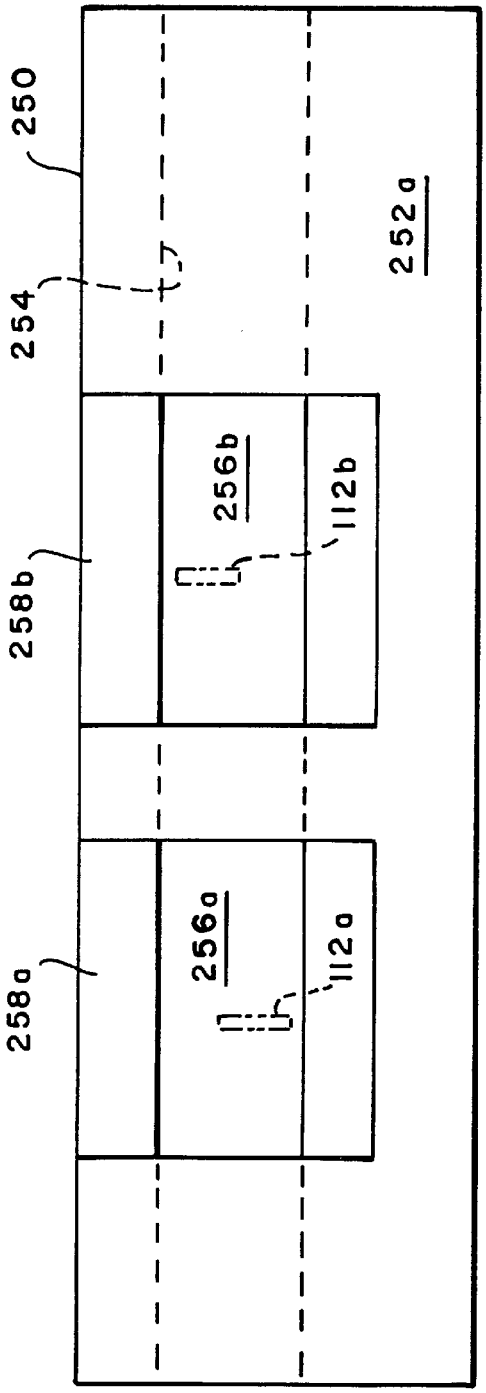
FIG. 2*a* is a plan view of a registration shield for use in the mailing machine in accordance with the present invention.
Figure 2C:
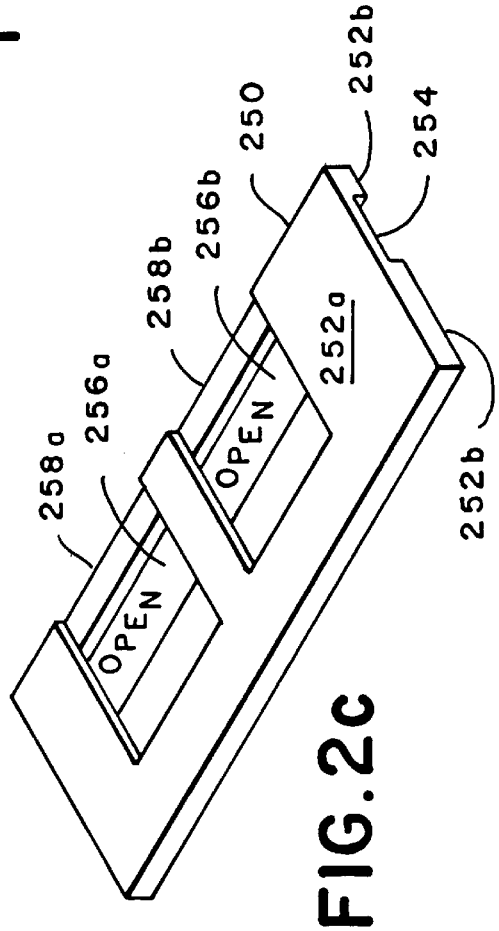
FIG. 2*c* is a perspective view of the registration shield for use in the mailing machine in accordance with the present invention.

Referring to FIGS. 2*a*, 2*b* and 2*c*, the details of the registration shield 250 are shown. So that the relationship of the registration shield 250 to the printer module 100 (not shown) can be better understood, the arrays of nozzles 112*a* and 112*b* are shown in dotted lines. The registration shield 250 is generally rectangular in shape and includes a top surface 252*a* and a bottom surface 252*b*. The bottom surface 254 includes a generally U-shaped channel 254 extending parallel to the path of travel from one end of the registration shield 250 to the other end. As described above, the rollers 234 (not shown) operate to bias the top surface of the envelope 20 (not shown) against the bottom surface 252*b* of the registration shield. In this manner, the envelope 20 does not contact the registration shield 250 in the area of the channel 254. Instead, the top surface of the envelope 20 rides along the bottom surface 252*b*.

The registration shield 250 further includes a plurality of openings 256*a* and 256*b* corresponding to the first array of nozzles 112*a* and the second array of nozzles 112*b*, respectively. The openings 256*a* and 256*b* are suitably large and positioned to allow the arrays of nozzles 112*a* and 112*b*, respectively, to fire droplets of ink through them. In the preferred embodiment, the openings 256*a* and 256*b* are located to be coincident (overlapping) with the channel 254.

The top surface 252*a* of the registration shield 250 includes a pair of generally U-shaped relief channels 258*a* and 258*b* corresponding to the first cartridge 110*a* (not shown) and the second cartridge 110*b* (not shown), respectively. The relief channels 258*a* and 258*b* extend transverse to the path of travel beginning along an end of the registration shield 250 nearest to the printer module 100 (not shown) and terminating before reaching the opposite end of the registration shield 250.

Referring to FIGS. 1 and 3, the conveyor apparatus 200, the user interface 380 and the printer module 100 are under the control of the micro control system 300 which may be of any suitable combination of microprocessors, firmware and software. The micro control system 300 includes a motor controller 310 which is in operative communication with the motor 260, a print head controller 320 which is in operative communication with the printer module 100, a sensor controller 330 which is in operative communication with the sensor module 500, an accounting module 340 (postage meter) for tracking postal funds, a microprocessor 360 and a security application specific integrated circuit (ASIC) 370. Additionally, the micro control system 300 is in operative communication with the encoder system 270 via the encoder detector 274. The micro control system 300 constantly compares the actual position of the envelope 20 with the desired position of the envelope 20 and computes appropriate corrective drive signals, which are communicated to the motor controller 310. The motor controller 310 then provides energizing signals to the motor 260 in response to the drive signals received from the micro control system 300. Those skilled in the art will recognize that the various components of the micro control system 300 are in operative communication with each other over conventional communication lines, such as a communication bus.

Figure 4:
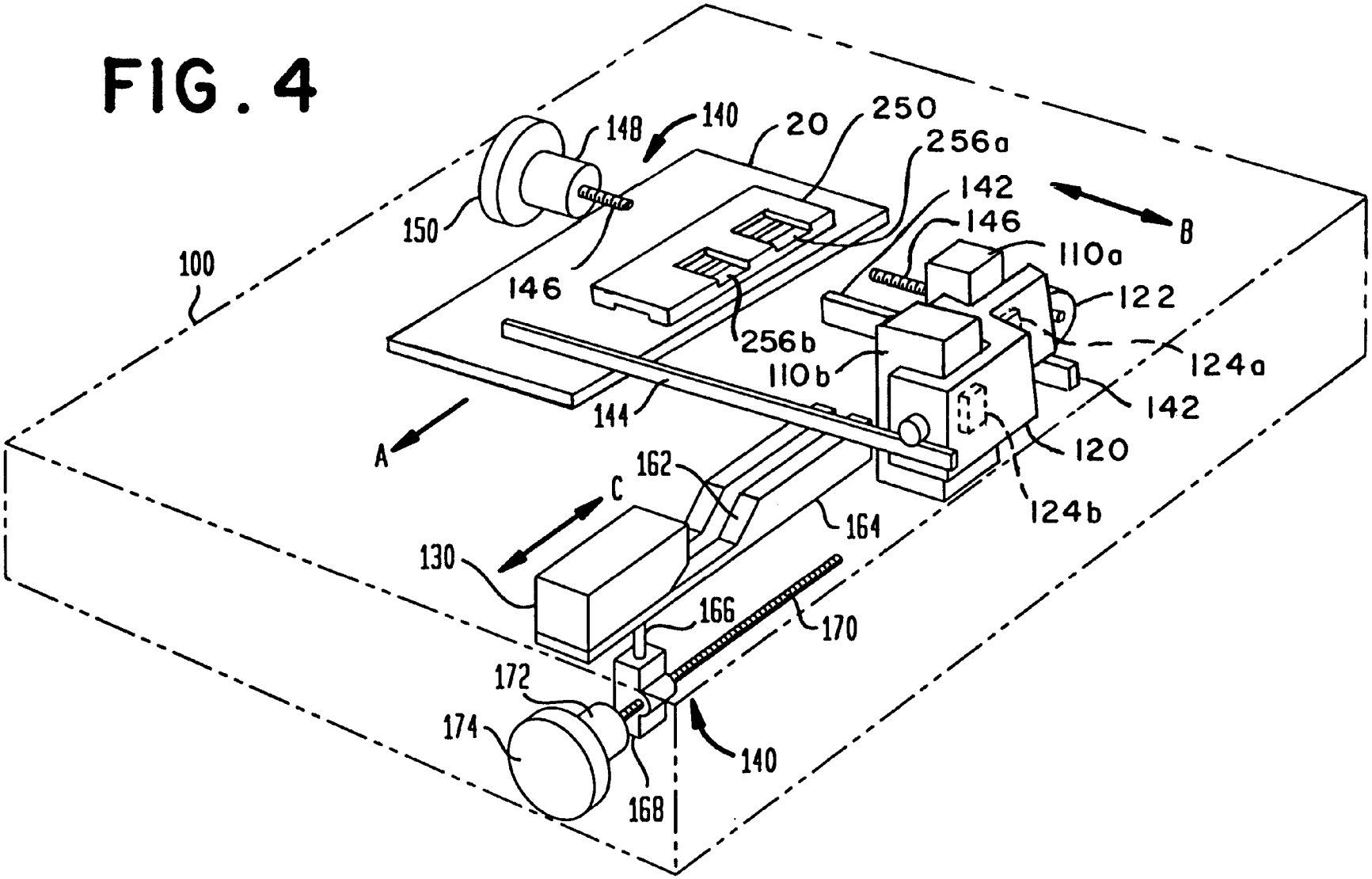
FIG. 4 is a more detailed schematic of a perspective view of the printer module including the registration shield and a pair of print cartridges in accordance with the present invention.

Referring to FIG. 4, a more detailed view of the printer module 100 is shown. The printer module 100 includes the carriage 120, the pair of ink jet cartridges 110*a* and 110*b* each detachably mounted to the carriage 120, a maintenance assembly 130 and an assembly 140 for repositioning the carriage 120 and the maintenance assembly 130 into and out of operative engagement. The ink jet cartridges 110*a* and 110*b* are detachably mounted to connectors 124*a* and 124*b*, respectively, which are in turn fixably mounted to the carriage 120. Print data signals are supplied to the ink jet cartridges 110*a* and 110*b* from the print head controller 320 (not shown) via the connectors 124*a* and 124*b*, respectively. The maintenance assembly 130 operates to wipe and cap the cartridges 110*a* and 110*b* in conventional fashion. The printer module 100 further includes suitable framework (not shown) for supporting the various components of the printer module 100.

The printer module 100 is used for printing a postal indicia on the envelope 20, which travels in the direction indicated by the arrow A. The repositioning assembly 140 includes a pair of rails 142 and 144, respectively, on which the carriage 120 rests. A lead screw 146 is driven by a drive motor 148 Sand threadingly engages a nut 122 fixably attached to the carriage 120 in order is to translate the carriage 120 back and forth along the rails 142 and 144 as indicated by a double sided arrow B. A conventional encoder system 150 is operatively connected to the drive motor 148 for providing signals indicative of the position of the carriage 120 along the lead screw 146. The carriage 120 can be stopped at various positions along the lead screw 146 depending upon whether the cartridges 110*a* and 110*b* are printing or engaged with the maintenance assembly 130. To print on the envelope 20, the carriage 120 is driven along the rails 142 and 144 until the arrays of nozzles 112*a* and 112*b* are positioned over the openings 256*a* and 256*b*, respectively, of the registration shield 250.

The repositioning assembly 140 further includes suitable structure for repositioning the maintenance assembly 130. The maintenance assembly 130 travels along a track 164 having a camming surface 162 as indicated by a double-sided arrow C. A pin 166 engages an aperture (not shown) in the maintenance assembly 130 to reposition the maintenance assembly 130 along the track 164. The pin 166 is seated in a block 168, which threadingly engages a lead screw 170, which in turn is driven by a drive motor 172. Additionally, a conventional encoder system 174 is operatively connected to the drive motor 172 for providing signals indicative of the position of the maintenance assembly 130 along the lead screw 170. The maintenance assembly 130 can be stopped at various positions along the lead screw 170 depending upon whether the cartridges 110*a* and 110*b* are printing or engaged with the maintenance assembly 130.

With the structure of the mailing machine 10 described as above, the operational characteristics will now be described with reference primarily to FIG. 1 while viewing the detailed structures of FIGS. 2*a*, 2*b*, 2*c*, 3, and 4. As the envelope 20 is fed into the print area, the normal force rollers 234 bias the envelope 20 upward against the bottom surface 252*b* of the registration shield 250. With the carriage 120 in the print position, the arrays of nozzles 112*a* and 112*b* are positioned to fire droplets of ink through the openings 256*a* and 256*b*, respectively, onto the envelope 20. Since the channel 254 is not in contact with the envelope 20 and since the channel 254 extends throughout the length of the registration shield 250, air is allowed to circulate through the openings 256*a* and 256*b* from one side of the registration shield 250 to the other due in part to the Venturi effect generated by the movement of the envelope 20. Generally, the movement of the envelope 20 creates air currents. These currents have an eddy effect that carry the dust particles away from the arrays of nozzles 112*a* and 112*b*. In this manner, the arrays of nozzles 112*a* and 112*b* are less susceptible to contamination.

Having the channel 254 extend the entire length of the registration shield 250 also provides other benefits. First, the bottom surface 252*b* of the registration shield 250 will not smear the printed image of the postal indicia since the postal indicia is contained completely within the channel 254. That is, the channel 254 is wider in the direction transverse to the path of travel than the end to end dimension of the arrays of nozzles 112*a* and 112*b*. Thus, having the channel 254 extend downstream in the path of travel from the arrays of nozzles 112*a* and 112*b* to the downstream end of the registration shield 250 provides a benefit. Second, empirical testing has indicated that having the channel 254 extend upstream in the path of travel from the arrays of nozzles 112*a* and 112*b* to the downstream end of the registration shield 250 increase air flow through the openings 256*a* and 256*b*. Additionally, since the envelope 20 is not in contact with the registration shield 250 in the area of the channel 254, no scraping of the envelope 20 occurs which tends to generate loose paper fibers.

It is important to note that the sizing and location of the openings 256*a* and 256*b* with respect to the arrays of nozzles 112*a* and 112*b* influences the performance of the registration shield 250. Empirical testing has shown that in the vicinity of the upstream edge of each of the openings 256*a* and 256*b* the air flow patterns are generally swirls and highly turbulent. On the other hand, the air flow patterns in the more central regions of the openings 256*a* and 256*b*, respectively, do not take on this characteristic behavior. Empirical testing has shown that swirls are much more likely to deposit dust on the arrays of nozzles 112*a* and 112*b*. Thus, in the preferred embodiment, the upstream edge of each of the openings 256*a* and 256*b* has been located at least about 0.200 inches, and preferably about 0.250 inches, upstream from the arrays of nozzles 112*a* and 112*b*. In this manner, the swirling air patterns do not occur in proximity to the arrays of nozzles 112*a* and 112*b*. Generally, it is preferable to have this amount of clearance all around the periphery of the arrays of nozzles 112*a* and 112*b*, respectively.

Other dimensional aspects of the registration shield 250 are important to its performance. One important dimension is the depth of the channel 254 from the bottom surface 252*b* which is set to a range of about 0.020 to 0.050 inches and preferably 0.030 inches. In this manner, the negative consequences of puffy envelopes and envelope pillowing are reduced. Puffy envelopes are generally caused by the irregular contents of the envelope 20, such as: paper clips, inserts and staples. Envelope pillowing is generally caused by air trapped inside the envelope 20 trying to escape whenever the envelope 20 is compressed, such as when the normal force rollers 234 bias the envelope 20 against the registration shield 250. Both puffy envelopes and envelope pillowing cause irregularities in the top surface of the envelope 20. Empirical testing has revealed that if the channel 254 is too shallow, then the top surface of the envelope 20 may come in contact with the channel 254 defeating the beneficial effects of the channel 254. On the other hand, if the channel 254 is too deep, then the top surface of the envelope 20 may be spaced too far from the arrays of nozzles 112*a* and 112*b* to yield quality printing.

Another important dimension is the overall thickness of the registration shield 250 because it performs several critical functions. The registration shield 250 must be rigid enough so that is does not deform under the forces that are created by the normal force rollers 234 compressing the envelope 20 up against it. In this way, a consistent print gap is maintained between the arrays of nozzles 112*a* and 112*b* and the top surface of the envelope 20. Additionally, the registration shield 250 must protect the ink jet cartridges 110*a* and 110*b* from damage. Thus, if an oversized envelope is place in the print area, then the registration shield 250 must not collapse and come into contact with the ink jet cartridges 110*a* and 110*b*. In the preferred embodiment, the registration shield 250 is made from at least about 0.060 inches thick stainless steel and preferably 0.093 inches thick stainless steel.

Generally, the relief channels 258*a* and 258*b* are provided to allow for clearance between the ink jet cartridges 110*a* and 110*b* and the registration shield 250 so that the print gap between the arrays of nozzles 112*a* and 112*b* may be set to a desired dimension. In the preferred embodiment, the print gap is set to 0.070 inches. However, those skilled in the art will recognized that this dimension is dependent upon the particular type of ink jet technology being employed. It is important that the relief channels 258*a* and 258*b* commence on the top edge of the registration shield 250 and extend transverse to the path of travel along the top surface 252*a* of the registration shield 250. In this manner, as the ink jet cartridges 110*a* and 110*b* are driven along the rails 114 and 146 to the print position, no part of the ink jet cartridges 110*a* and 110*b* come into contact with the registration shield 250 and that adequate clearance is maintained. Thus, damage to the registration shield 250 and the ink jet cartridges 110*a* and 110*b* from collisions is avoided.

Based on the above description and the associated drawings, it should now be apparent that the present invention substantially overcomes the problems associated with registering the top surface of an envelope at a predetermined distance from a print head. Importantly, by using a channel on the bottom surface of the registration shield, the negative consequences of paper dust accumulating on the arrays of nozzles is reduced.

Many features of the preferred embodiment represent design choices selected to best exploit the inventive concept as implemented in a mailing machine utilizing individual bubble jet ink cartridges. However, those skilled in the art will recognize that the concepts of the present invention are applicable to a single print head design where the arrays of nozzles are integrated into a single cartridge.

Moreover, those skilled in the art will recognize that various modifications can be made without departing from the spirit of the present invention. For example, the preferred embodiments are described with respect a channel cut into the bottom surface of the registration shield. However, those skilled in the art will readily be able to adapt the inventive concepts to a registration shield instead having ribs running along its bottom surface so as to create a zone where the envelope does not contact the registration shield.

Therefore, the inventive concept in its broader aspects is not limited to the specific details of the preferred embodiments but is defined by the appended claims and their equivalents.

What is claimed is:

1. A mailing machine comprising:

a printer module including an array of ink jet print elements for printing on an envelope having a top surface;

a registration shield located below and spaced apart from the array of ink jet print elements to define a print gap, the registration shield including an opening through which the array of ink jet print elements project ink onto the top surface of the envelope, the registration shield having a top surface facing toward the array of ink jet print elements and a bottom surface facing away from the array of ink jet print elements; and transport means for feeding the envelope in a path of travel through the printer module, the transport means including means for biasing the top surface of the envelope into contact with the bottom surface of the registration shield; and the registration shield further including a channel on the bottom surface extending parallel to the path of travel so that a portion of the top surface of the envelope opposed to the channel does not contact the bottom surface of the registration shield allowing air to flow through the opening between the print gap and the channel.

2. The mailing machine of claim 1, wherein:

the channel extends downstream in the path of travel from the opening the entire length of registration shield so that ink applied to the top surface of the envelope by the array of ink jet print elements does not come into contact with the bottom surface of the registration shield and smear.

3. The mailing machine of claim 2, wherein:

the opening has a lead edge that is at least about 0.200 inches upstream in the path of travel from the array of ink jet print elements so that swirls of air produced along the lead edge of the opening have a diminished effect in the print gap adjacent to the array of ink jet print elements.

4. The mailing machine of claim 3, wherein:

the channel extends upstream in the path of travel from the opening the entire length of registration shield so that the top surface of the envelope does not come in contact with the bottom surface of the registration shield in an area in alignment with the array of ink jet print elements reducing an amount of paper dust generated in the print gap adjacent to the array of ink jet print elements.

5. The mailing machine of claim 4, wherein:

the channel has a depth of about 0.030 inches.

6. The mailing machine of claim 3, wherein:

the channel is in overlapping alignment with the opening in the direction of travel.

7. The mailing machine of claim 1, wherein:

the channel has a depth of about 0.030 inches.

8. The mailing machine of claim 1, wherein:

the opening has a lead edge that is at least about 0.200 inches upstream in the path of travel from the array of ink jet print elements so that swirls of air produced along the lead edge of the opening have a diminished effect in the print gap adjacent to the array of ink jet print elements.

9. The mailing machine of claim 1, wherein:

the channel is in overlapping alignment with the opening in the direction of travel.

* * * * *